US006769348B2

(12) United States Patent
Hudson et al.

(10) Patent No.: US 6,769,348 B2
(45) Date of Patent: Aug. 3, 2004

(54) HYDRAULIC SYSTEM WITH FLOW PRIORITY FUNCTION

(75) Inventors: Michael D. Hudson, Plainfield, IL (US); John P. Mitchell, Plainfield, IL (US)

(73) Assignee: Caterpillar Inc, Peoria, IL (US)

( * ) Notice: Subject to any disclaimer, the term of this patent is extended or adjusted under 35 U.S.C. 154(b) by 117 days.

(21) Appl. No.: 10/188,202

(22) Filed: Jul. 2, 2002

(65) Prior Publication Data

US 2003/0005820 A1 Jan. 9, 2003

Related U.S. Application Data

(60) Provisional application No. 60/302,906, filed on Jul. 3, 2001.

(51) Int. Cl.[7] ..... F15B 71/16
(52) U.S. Cl. ..... 91/516; 60/452
(58) Field of Search ..... 91/516; 60/422, 60/452

(56) References Cited

U.S. PATENT DOCUMENTS 4,385,674 A * 5/1983 Presley ..... 91/516
4,470,259 A 9/1984 Miller et al.
4,552,168 A 11/1985 Chatterjea
4,576,003 A * 3/1986 Rau et al. ..... 60/422
5,279,121 A 1/1994 Barber

* cited by examiner

*Primary Examiner*—F. Daniel Lopez
(74) *Attorney, Agent, or Firm*—Steve M Hanley; D James Barnes

(57) ABSTRACT

A hydraulic system includes a pressurized fluid supply, a plurality of non-priority elements each including a signal port and a supply port, at least one priority implement including a signal port and a supply port and a priority valve arrangement. The priority valve arrangement is adapted to receive fluid from the pressurized fluid supply and selectively apportion fluid between the supply port of the priority implement and the supply ports of the plurality of non-priority elements. The valve arrangement includes a signal circuit operative to establish a flow priority between the priority implement and the plurality of non-priority implements and the signal circuit is in fluid communication with the priority supply. The signal circuit includes a pilot portion and a dynamic load portion and the signal port of the priority implement is in fluid communication with the priority valve arrangement through the dynamic load portion of the signal circuit. The signal ports of the plurality of non-priority implements are in fluid communication with the priority supply, wherein the dynamic load signal and the load signal are substantially prevented from fluid communication with one another to provide a stabilized dynamic load signal.

8 Claims, 1 Drawing Sheet

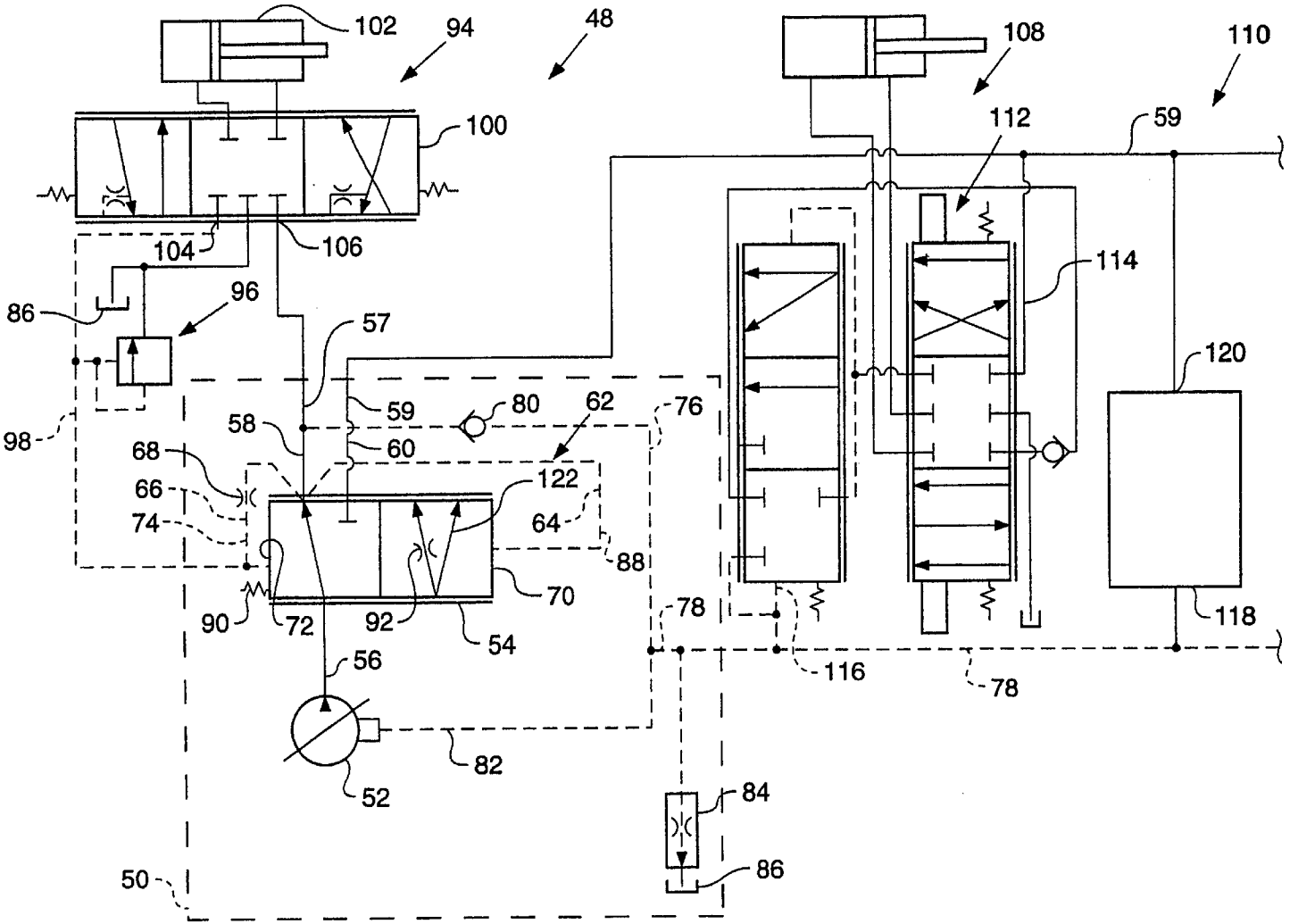
110
108
112
59
114
120
118
78
116
84
86
76
88
48
62
122
64
70
80
54
82
94
100
102
106
57
59
60
92
56
52
72
58
96
90
104
68
66
74
50
86
98

HYDRAULIC SYSTEM WITH FLOW PRIORITY FUNCTION

This application claims the benefit of prior provisional patent application Serial No. 60/302,906 filed Jul. 3, 2001.

TECHNICAL FIELD

The present invention relates to a system for prioritizing fluid flow or pressure directed to a plurality of implements in a flow-share arrangement.

BACKGROUND

Hydraulic systems which receive an input flow and correspondingly provide multiple output flows, albeit in a controlled, predetermined priority are well known. Such hydraulic circuits are desirable and commonly employed in association with machines which are capable of performing multiple simultaneous or contiguous functions. For instance, a priority circuit may be employed in a hydraulic system of an earthmoving machine to orchestrate pressure and/or flow control between a steering system and an implement system as the two systems are simultaneously commanded. Without this priority scheme provided by the hydraulic system, steering control may be rendered ergonomically unmanageable as the operator positions, activates or otherwise animates the implement.

A typical hydraulic circuit, having flow prioritizing capabilities, generally includes a pump in fluid communication with priority and non-priority implements through a priority valve. The priority valve is in fluid communication with a signal line which urges the valve to modulate pump flow between priority and non-priority implements. The signal line is attached to a priority supply port of the priority valve and is diverted into a dynamic load signal line and a load signal line. The load signal line and a priority implement signal line is attached to the dynamic load signal. A bleed valve is installed in the load signal line to accordingly stabilize signal pressure. A shuttle valve is typically positioned upstream of the bleed valve to prevent the load signal from disrupting the dynamic load signal.

The shuttle valve is typically configured to provide signal flow to the pump from either the dynamic load signal or the load signal. However, during high load use of the priority valve a non-priority signal margin becomes unstable since fluctuations in load of the priority supply, are not communicated to the non-priority implements. Consequently, the non-priority implements are rendered inoperable or difficult to operate when a high demand is in effect on the priority implement.

Alternatively, a second type of priority valve, similar to the previously described priority valve, has previously been used. However rather than employing the shuttle valve in the load signal line, a check valve is provided upstream of the bleed valve. Consequently, the dynamic load signal is prone to significant parasitic loss which may be at least partially attributable to a fluctuating load signal. As a result, when the priority implement is under command and the dynamic load signal is substantially below a suitable value, the operation of the priority implement is adversely affected. For instance, if the priority implement is a hand metering unit (HMU), such as a steering valve, and the dynamic load signal has suffered a significant loss, an operator would likely experience difficulty (i.e., "hard spots") as he or she attempted to turn the steering wheel.

Therefore, a priority valve system which includes a dynamic load signal not significantly influenced by the load signal, or any other influence, is desirable. Furthermore, a priority valve system which is configured to provide a controllable non-priority signal margin during high load priority function operation is desirable. Moreover, a priority valve arrangement capable of prioritizing flow, pressure or a combination thereof in a multiple implement system arrangement is highly desirable.

The present invention is directed to overcoming one or more of the problems as set forth above.

SUMMARY OF THE INVENTION

In one aspect of the present invention a hydraulic system is provided and includes a pressurized fluid supply, a plurality of non-priority elements each including a signal port and a supply port, at least one priority implement including a signal port and a supply port and a priority valve arrangement. The priority valve arrangement is adapted to receive fluid from the pressurized fluid supply and selectively apportion fluid between the supply port of the priority implement and the supply ports of the plurality of non-priority elements. The valve arrangement includes a signal circuit operative to establish a flow priority between the priority implement and the plurality of non-priority implements and the signal circuit is in fluid communication with the priority supply. The signal circuit includes a pilot portion and a dynamic load portion and the signal port of the priority implement is in fluid communication with the priority valve arrangement through the dynamic load portion of the signal circuit. The signal ports of the plurality of non-priority implements are in fluid communication with the priority supply, wherein the dynamic load signal and the load signal are substantially prevented from fluid communication with one another to provide a stabilized dynamic load signal.

BRIEF DESCRIPTION OF THE DRAWING

FIG. 1 is a schematic representation of a hydraulic system according to the present invention.

DETAILED DESCRIPTION

Referring to FIG. 1, hydraulic system 48 includes a valve arrangement 50 having a variable output, flow compensated pump 52 in fluid communication with a two-position valve 54 through conduit 56. Valve 54 includes a first position in which all flow from the pump 52 is directed to a priority supply passage 58. In contrast and in accordance with the first valve position, it may be seen that a non-priority supply passage 60 within valve 54 is blocked. Valve 54 includes a second position in which flow is established from the pump 52 to the non-priority supply passage 60 and flow from the pump 52 to the priority supply passage 58 is restricted.

Valve arrangement 50 further includes a signal circuit 62 in fluid communication with the priority supply passage 58 connected to valve 54. The signal circuit 62 is split into a pilot signal portion 64 and a dynamic load signal portion 66. The dynamic load signal portion 66 is in fluid communication with a fluid metering restriction 68, such as an orifice, for example, and the pilot signal portion 64 is in fluid communication with a first pilot end 70 of valve 54. Valve 54 also includes a second pilot end 72 which is in fluid communication with the dynamic load signal portion 66 of the signal circuit 62. The signal flow downstream of the orifice 68 is referred to as a dynamic load signal 74 and the dynamic load signal 74 is systematically sustained near a constant value through modulation of valve 54 as hereinafter described.

It may be seen that valve 54 includes a first position (as shown in FIG. 1) corresponding to directing pump flow to the priority supply 57 through priority supply passage 58. However, as the pressure builds to a target or desired value, the valve 54 shifts to its second position due to a difference in the dynamic load signal 74, exerted on end 72 of valve 54, and a pilot signal 88, exerted on end 70 of valve 54. Notably, in order for the valve 54 to shift to its second position the pressure difference must generate a resultant force to overcome a biasing force provided by spring 90. In this second position, pump flow is shared; a portion being directed to the priority supply 57 through an orifice 92 and the remaining portion is directed to the non-priority supply 59. The valve arrangement 50 further includes a bleed valve 84 positioned within the load signal line 78 downstream of the load signal passage 76 and accordingly discharges signal flow to tank 86.

Signal circuit 62 of the valve arrangement 50 also includes a dedicated load signal passage 76 fluidly connecting the priority supply 57 to a load signal line 78. A one-way check valve 80 is included in the load signal passage to prevent signal flow downstream of valve 80 to influence operation of valve arrangement 50. Additionally, a flow compensation signal passage 82 fluidly connects the pump 52 to the load signal line 78.

The priority supply 57 of valve arrangement 50 is fluidly connected to a priority implement 94, such as a hand-metering unit (HMU) used for steering control, for example. In an exemplary embodiment, the priority implement includes a steering valve 100 in fluid communication with an actuator cylinder 102 which is accordingly coupled to steering linkage (not shown). The priority implement 94 includes a signal port 104 in fluid communication with the dynamic load signal 74 from the valve arrangement 50. A supply port 106 is provided by the priority implement and is fluidly connected to the priority supply 57 of the valve arrangement 50.

The non-priority supply 59 of valve arrangement 50 is fluidly connected to non-priority implements 108 and 110. It is envisioned that one, two or multiple non-priority implements may be hydraulically connected to the valve arrangement 50. In an exemplary embodiment, non-priority implement 108 and 110 may be configured to control a load-handling arm, for example. The non-priority implement 108, in the exemplary embodiment, includes a single spool valve arrangement 112 including a supply port 114 fluidly connected with the non-priority supply 59 and a signal port 116 in fluid communication with the load signal line 78. Implement 110, may be an implement similar to implement 108 or any other suitable implement known to those having ordinary skill in the art. Non-priority implement 110 includes a signal port 118 and supply port 120 which respectively fluidly connect with the load signal line 78 and the non-priority supply 59.

INDUSTRIAL APPLICABILITY

In operation, the priority implement is prompted to perform an operation through, for example, a user input command and in response the dynamic load signal 74, affects valve 54 such that the valve is urged into its first position. In this position the priority implement has exclusive flow priority from the pump. As this priority implement command is met by the dynamic load signal, the pressure builds in the pilot portion of the signal circuit causing a shift of valve 54 to its second position. In the second position the valve 54 restricts pump flow to the priority implement 94 through orifice 92 and the non-priority implements 108, 110 are fluidly connected to the pump 52 via passage 122 provided by valve 54. Hence, operational command of the non-priority implement is satisfied and subsequent thereto, the valve 54 directs flow to the non-priority implements while restricting flow to the priority implement.

It may be seen that the non-priority implements may exert a significant demand on both the signal load 78 and the non-priority supply 59. However, the signal circuit 62 is protected from influence by the load signal 78 since the load signal is fluidly connected with the priority supply 57 through a dedicated connection. Consequently, the dynamic load signal may be stabilized with insignificant influence from the load signal line 78.

Moreover, since the load signal line 78 is in direct and dedicated communication with the priority supply 57, a high load demand placed on the priority implement 94 does not significantly affect controllability of the signal load 78 to flow compensators (not shown) in respective fluid communication with each non-priority implement 108, 110.

From the foregoing, it is readily apparent that the subject hydraulic system 48 selectively apportions flow between priority and non-priority implements in a flow share arrangement and in so doing provides a stabilized dynamic load signal which is insignificantly affected by the load signal.

Other aspects, objects and advantages of the invention can be obtained from a study of the drawing, the disclosure and the appended claims.

What is claimed is:

1. A hydraulic system comprising:

a pressurized fluid supply;

a plurality of non-priority elements each including a signal port and a supply port;

at least one priority implement including a signal port and a supply port;

a valve arrangement adapted to receive fluid from said pressurized fluid supply and selectively apportion fluid between said supply port of said at least one priority implement and said supply ports of said plurality of non-priority elements, said valve arrangement comprising: a signal circuit operative to establish a flow priority between said at least one priority implement and said plurality of non-priority elements, said signal circuit being in fluid communication with said priority implement via a priority supply, said signal circuit having a pilot portion and a dynamic load portion;

said signal port of said priority implement being in fluid communication with said valve arrangement through said dynamic load portion of said signal circuit, said signal ports of said plurality of non-priority elements being in fluid communication with said priority supply, wherein said dynamic load portion is substantially prevented from fluid communication with said signal ports of said non-priority elements to provide a stabilized dynamic load signal.

2. The hydraulic system of claim 1 wherein the valve arrangement includes a multi-position valve having first and second pilot ends, the valve being biased to a first position at which all of the fluid flow from the pressurized fluid supply is directed to the priority implement and movable towards a second position at which a portion of the flow is directed to the priority implement and a portion of the fluid flow is directed to the non-priority elements.

3. The hydraulic system of claim 2 wherein the priority supply is disposed in fluid communication between the signal circuit and the priority implement and said dynamic load portion of said signal circuit is disposed between the priority supply and the second pilot end of the multi-position valve.

4. The hydraulic system of claim 3 wherein the dynamic load portion includes a fluid metering restriction therein to define the dynamic load signal between the fluid metering restriction and the second pilot end of the multi-position valve, the signal port of the priority implement being fluidly connected to the dynamic load signal.

5. The hydraulic system of claim 4 wherein the pilot portion of the signal circuit is fluidly connected between the priority supply and the first pilot end of the multi-position valve.

6. The hydraulic system of claim 5 wherein the priority supply is fluidly connected with the signal ports of the non-priority elements via a one-way check valve.

7. The hydraulic system of claim 6 wherein the pressurized fluid supply is a flow compensated pump having a flow compensator, the signal ports of the non-priority elements and the priority supply being in fluid communication with the flow compensator of the flow compensated pump.

8. The hydraulic system of claim 7, further including a fluid tank and a bleed valve disposed between the signal ports of the non-priority elements and the fluid tank.

* * * * *